US009890090B2

(12) United States Patent
Banning et al.

(10) Patent No.: US 9,890,090 B2
(45) Date of Patent: Feb. 13, 2018

(54) MELT-CASTABLE NITRAMINE BINDERS FOR HIGH ENERGY COMPOSITIONS

(71) Applicant: THE UNITED STATES OF AMERICA AS REPRESENTED BY THE SECRETARY OF THE ARMY-U.S. ARMY RESEARCH LABORATORY, Washington, DC (US)

(72) Inventors: Joseph Erik Banning, North East, MD (US); William Matthew Sherrill, Aberdeen, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 130 days.

(21) Appl. No.: 14/838,406

(22) Filed: Aug. 28, 2015

(65) Prior Publication Data

US 2017/0057884 A1 Mar. 2, 2017

(51) Int. Cl.

| | |
|---|---|
| ***C06B 25/34*** | (2006.01) |
| ***D03D 23/00*** | (2006.01) |
| ***D03D 43/00*** | (2006.01) |
| ***C06B 21/00*** | (2006.01) |

(52) U.S. Cl.
CPC ..... *C06B 25/34* (2013.01); *C06B 21/005* (2013.01)

(58) Field of Classification Search
USPC ..... 149/92, 109.2, 109.4, 109.6
See application file for complete search history.

(56) References Cited

U.S. PATENT DOCUMENTS 4,614,800 A * 9/1986 Willer ..... C06B 25/34 540/475
9,073,800 B1 * 7/2015 Stepanov ..... C06B 45/22

* cited by examiner

*Primary Examiner* — James McDonough
(74) *Attorney, Agent, or Firm* — Robert Thompson

(57) ABSTRACT

Provided is a melt-castable binder useful for stabilizing high energy explosive materials. A melt-castable nitramine binder has high energy in its own right yet is very insensitive to accidental detonation such as by shock or friction. The melt-castable nitramine binder is optionally combined with one or more high energy materials in the formation of an explosive composition with improved energy yield and safety and handling parameters relative to the high energy material alone.

7 Claims, No Drawings

MELT-CASTABLE NITRAMINE BINDERS FOR HIGH ENERGY COMPOSITIONS

GOVERNMENT INTEREST

The invention described herein may be manufactured, used, and licensed by or for the United States Government.

FIELD

The invention relates to the field of explosives. More specifically, compositions are provided that utilize a melt-castable nitramine binder to form a stable high energy material to promote explosive capabilities with improved handling.

BACKGROUND

Development of explosive compositions for military applications has historically been motivated by the need for explosives with high energy output. The need for increased explosive performance of such high energy munitions has become ever more important in modern military programs. Increasing the energy output of energetic compositions, however, couples with an increased problem of risk of unwanted detonation due to shock or friction. This problem has always plagued the military, but in recent years it has become more critical. As explosive power increases, the materials tend to become more sensitive and vulnerable to accidental detonation.

Historical production of high energy materials with suitable handling properties and low risk of unwanted detonation has typically followed a few common pathways. The first is to combine a high energy material with a lower energetic binder such as trinitrotoluene or nitrocellulose. Such compositions reduce the amount of high energy material, but remain too unstable for modern use. A second path is to increase the amount of high energy material, but combine it with an inert binder such as an organic wax or polymer. The problem becomes finding the right balance of high energy material and inert binder to provide the necessary balance of explosive power and safety. The final approach taken is to synthesize new high energy compositions that may inherently possess the right balance of explosive power and insensitivity to unwanted detonation.

Further adding complexity to methods to craft an explosive with the proper power and safety, is the fact that there are different types of packaging or uses that dictate physical characteristics of the material either during production or use. Castable explosives, as one type, are classified either as melt-cast or as plastic bonded. Melt-cast systems require the melting of the explosive, for example TNT (m.p. 81° C.), and casting into a munition. Plastic bonded systems involve a mixture of one or more explosives with a polymeric binder, casting into a munition or mold, and curing of the binder. Thus, any compositions for improving safety or handling properties of the energetic material must have the physical characteristics that allow them to function in either a melt-castable system or a plastic bonded system as desired.

The explosive formulations developed to date using the techniques described above have not yielded high energy output explosives that demonstrate a low enough susceptibility to sympathetic detonation to be considered for use in insensitive munitions. Previous efforts have failed in this respect in that they did not discover the proper combination filler or binder (i.e. in either chemical type or concentration level) to yield these properties.

As such, there is a need for new explosive compositions with enhanced detonation properties and improved safety.

SUMMARY

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

The compositions provided address the long standing issues of improving high energy output of detonable materials while simultaneously improving safety by decreasing the sensitivity to unwanted or other accidental detonation. The compositions and processes combine a melt-castable nitramine binder with a detonable energetic material, optionally with a laser shock velocity of 650 m/s or greater, to form a detonable composition with the desired high energy output and safety.

As such, provided are detonable compositions that include a detonable energetic material and a melt-castable nitramine binder with a melting point of 150 degrees Celsius or below. The detonable energetic material and melt-castable nitramine binder are optionally intermixed, optionally with the detonable material added to a melted binder, optionally to saturation. The melt-castable nitramine binder optionally is or includes a structure of formula I:

Formula I

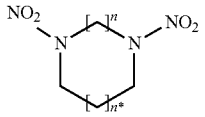

where n=1, 2, or 3 and n*=0, 1, 2, or 3. In some aspects, n and n* are both 1. A detonable energetic material optionally has a melting point of 80 degrees Celsius to 90 degrees Celsius. A composition optionally includes a concentration of nitramine binder of 20% to 80% by weight. A melt-castable nitramine binder is, in some aspects, mixed with a detonable energetic material that is: 1,3,5-trinitro-1,3,5-triazacyclohexane (1,3,5-trinitroperhydro-1,3,5-triazine; RDX); 1,3,5,7-tetranitro-1,3,5,7-tetrazocane (1,3,5,7-tetranitro-1,3,5,7-tetrazocane; HMX); 2,2-bis(hydroxymethyl) 1,3-propanediol (pentaerythritol tetranitrate; PETN); 2,4,6-trinitrotoluene (2-methyl-1,3,5-trinitrobenzene; TNT), 1,2,3-trinitroxypropane (trinitroglycerin; TNG); 2,3-dimethyl-2,3,-dinitrobutane (2,3-dimethyl-2,3-dinitrobutane; DMDNB); triacetone triperoxide (TATP); hexamethylene triperoxide diamine (HMTD); other peroxide or nitrate based explosive materials; gunpowder(s); pentaerythritol (2,2-Bis(hydroxymethyl)1,3-propanediol; PE); military or commercial grades of C4; Semtex A1; Semtex H; 2,4-dinitroanisole (DNAN), 1,3-Dinitrobenzene (1,3-DNB); 1,3,5-Trinitrobenzene (1,3,5-TNB); hexanitrostilbene (HNS); croconic acid; pentolite; 2,4,6-triamino-1,3,5-trinitrobenzene (TATB); comp B; nitrotriazalone (NTO); hexanitrohexaazaisowurtzitane (CL-20); 1,1-diamino-2,2-dinitroethene (DADNE; FOX-7); or combinations thereof. Any combination of the forgoing is possible in some aspects.

Also provided are methods for forming an energetic composition including melting a melt-castable nitramine binder with a melting point of 150 degrees Celsius or below to form a melted nitramine binder, and combining a detonable energetic material with the melted nitramine binder, optionally to saturation. The composition is optionally transferred to a mold or warhead. The detonable energetic material and melt-castable nitramine binder are optionally intermixed, optionally with the detonable material added to a melted binder, optionally to saturation. The melt-castable nitramine binder optionally is or includes a structure of formula I:

Formula I

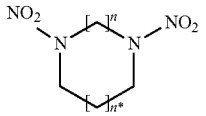

where n=1, 2, or 3 and n*=0, 1, 2, or 3. In some aspects, n and n* are both 1. A detonable energetic material optionally has a melting point of 80 degrees Celsius to 90 degrees Celsius. A composition optionally includes a concentration of nitramine binder of 20% to 80% by weight. A melt-castable nitramine binder is, in some aspects, mixed with a detonable energetic material that is: 1,3,5-trinitro-1,3,5-triazacyclohexane (1,3,5-trinitroperhydro-1,3,5-triazine; RDX); 1,3,5,7-tetranitro-1,3,5,7-tetrazocane (1,3,5,7-tetranitro-1,3,5,7-tetrazocane; HMX); 2,2-bis(hydroxymethyl) 1,3-propanediol (pentaerythritol tetranitrate; PETN); 2,4,6-trinitrotoluene (2-methyl-1,3,5-trinitrobenzene; TNT), 1,2,3-trinitroxypropane (trinitroglycerin; TNG); 2,3-dimethyl-2,3 dinitrobutane (2,3-dimethyl-2,3-dinitrobutane; DMDNB); triacetone triperoxide (TATP); hexamethylene triperoxide diamine (HMTD); other peroxide or nitrate based explosive materials; gunpowder(s); pentaerythritol (2,2-Bis(hydroxymethyl)1,3-propanediol; PE); military or commercial grades of C4; Semtex A1; Semtex H; 2,4-dinitroanisole (DNAN), 1,3-Dinitrobenzene (1,3-DNB); 1,3,5-Trinitrobenzene (1,3,5-TNB); hexanitrostilbene (HNS); croconic acid; pentolite; 2,4,6-triamino-1,3,5-trinitrobenzene (TATB); comp B; nitrotriazalone (NTO); hexanitrohexaazaisowurtzitane (CL-20); 1,1-diamino-2,2-dinitroethene (DADNE; FOX-7); or combinations thereof. Any combination of the forgoing is possible in some aspects.

DETAILED DESCRIPTION

The following description of particular aspect(s) is merely exemplary in nature and is in no way intended to limit the scope of the invention, its application, or uses, which may, of course, vary. The invention is described with relation to the non-limiting definitions and terminology included herein. These definitions and terminology are not designed to function as a limitation on the scope or practice of the invention but are presented for illustrative and descriptive purposes only. While the processes or compositions are described as an order of individual steps or using specific materials, it is appreciated that steps or materials may be interchangeable such that the description of the invention may include multiple parts or steps arranged in many ways as is readily appreciated by one of skill in the art.

It will be understood that, although the terms "first," "second," "third" etc. may be used herein to describe various elements, components, regions, layers, parameters and/or sections, these elements, components, regions, layers, parameters, and/or sections should not be limited by these terms. These terms are only used to distinguish one element, component, region, layer, parameter, or section from another element, component, region, layer, parameter, or section. Thus, "a first element," "component," "region," "layer," "parameter," or "section" discussed below could be termed a second (or other) element, component, region, layer, parameter, or section without departing from the teachings herein.

The terminology used herein is for the purpose of describing particular aspects only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. The term "or a combination thereof" means a combination including at least one of the foregoing elements.

Unless otherwise defined, all terms (including technical and scientific terms) used herein have the same meaning as commonly understood by one of ordinary skill in the art to which this disclosure belongs. It will be further understood that terms such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, the term "high energy" is defined as a material possessing a laser shock velocity of 650 m/s or greater under the conditions of Gottfried, J L, *Phys. Chem. Chem. Phys.,* 2014, 16, 21452.

As used herein, the term "insensitive" is defined as resistant to inadvertent detonation as a result of external stimulus such as mechanical or electrical shock, friction, among other standard tests known in the art. Insensitive is less sensitive than 2,4,6-trinitrotoluene (2-methyl-1,3,5-trinitrobenzene and 1,3,5-trinitro-1,3,5-triazacyclohexane in such tests.

Increasing energy density in explosive systems is highly desirable to provide improved outcome and to reduce weight and or size of the required high energy explosive material necessary. While several types of high energy explosive materials are available, many of these such as CL-20, require the inclusion of binders to increase the stability of the explosive materials for ease and safety of handling to reduce the likelihood of unwanted shock or friction detonation.

Provided are high energy materials that when combined with a melt-castable nitramine binder with a melting point of 150° C. or lower, produce an explosive composition with excellent energy release and safety, as well as usefulness in melt-cast explosive systems. The primary advantage of this material over other melt-castable binder systems is not only that the material is energetic in its own right, but it is very insensitive as well. This means that while conventional binder systems act as parasitic mass in a system since they have no inherent energy themselves, the nitramine binder systems as provided herein brings its own energy along with it, helping to increase the amount of energy available in the system. These nitramine binders are also incredibly insensitive as measured by small scale friction, impact, and ESD.

This means that they have the ability to stabilize some of the less stable components in a high energy formulation resulting in an overall decrease in the risk associated with using those formulations.

In some aspects, a binder material includes a composition that has the structure of Formula I:

Formula I

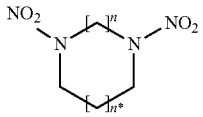

where n=1, 2, or 3 and n*=0, 1, 2, or 3. Specific illustrative examples of nitramines suitable for use as a binder in an explosive composition include those listed in Table 1 along with references for synthesis.

TABLE 1

Examples of known and unknown dinitraminocarbocycles and their melt points.

| Material | Melt (° C.) | Reference |
|---|---|---|
| 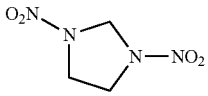 | 132-133 | Willer, R. L.; Atkins, R. L. J. Org. Chem. 1984, 49, 5147-5150. |
| 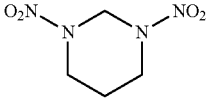 | 84-86 | Willer, R. L.; Atkins, R. L. J. Org. Chem. 1984, 49, 5147-5150. |
| 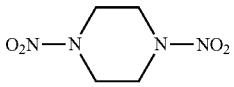 | 195 | Manelis, G. B. Phys. Chem. 2006, 2, 335-338. |
| 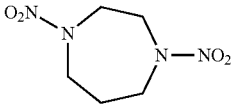 | 147-148 | Park, Y. J. Org. Chem. 2003, 23, 9113-9115. |
| 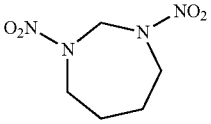 | N/A | Pickering, M. Acta. Cryst., Sect. B. 1991, 5, 782-789. |
| 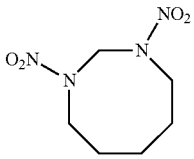 | N/A | N/A |
| 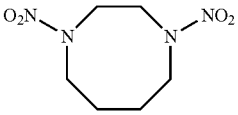 | N/A | N/A |
| 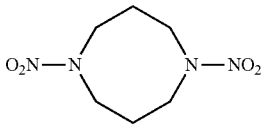 | N/A | N/A |

In some aspects, a melt-castable nitramine binder has a melting point of less than 150° C., optionally less than 100° C. In some aspects, a melt-castable nitramine binder has a melting point of between 70° C. and 100° C. or any value or range therebetween. In some aspects, a melt-castable nitramine binder has a melting point of 80° C. to 90° C.

An explosive composition includes a melt-castable nitramine binder at a concentration of 20% to 80% by weight relative to an energetic material if used alone or relative to the overall composition of the explosive composition. In some aspects, a melt-castable nitramine binder is present at 30% to 60% by weight. In some aspects, a melt-castable nitramine binder is present at 35% to 50% by weight.

An explosive composition optionally includes a melt-castable nitramine binder as provided herein and optionally one or more detonable energetic materials, optionally a high energy detonable energetic material. Illustrative examples of energetic materials include, but are not limited to: 1,3,5-trinitro-1,3,5-triazacyclohexane (1,3,5-trinitroperhydro-1,3,5-triazine; RDX); 1,3,5,7-tetranitro-1,3,5,7-tetrazocane (1,3,5,7-tetranitro-1,3,5,7-tetrazocane; HMX); 2,2-bis(hydroxymethyl)1,3-propanediol (pentaerythritol tetranitrate; PETN); 2,4,6-trinitrotoluene (2-methyl-1,3,5-trinitrobenzene; TNT), 1,2,3-trinitroxypropane (trinitroglycerin; TNG); 2,3-dimethyl-2,3,-dinitrobutane (2,3-dimethyl-2,3-dinitrobutane; DMDNB); triacetone triperoxide (TATP); hexamethylene triperoxide diamine (HMTD); other peroxide or nitrate based explosive materials; gunpowder(s); pentaerythritol (2,2-Bis(hydroxymethyl)1,3-propanediol; PE); military or commercial grades of C4; Semtex A1; Semtex H; 2,4-dinitroanisole (DNAN), 1,3-Dinitrobenzene (1,3-DNB); 1,3,5-Trinitrobenzene (1,3,5-TNB); hexanitrostilbene (HNS); croconic acid; pentolite; 2,4,6-triamino-1,3,5-trinitrobenzene (TATB); comp B; nitrotriazalone (NTO); hexanitrohexaazaisowurtzitane (CL-20); 1,1-diamino-2,2-dinitroethene (DADNE; FOX-7); and combinations thereof. An energetic material is optionally present at 40% to 80% by weight, or any value or range therebetween.

Some aspects include substituting a portion of the nitramine binder or high energy material with an oxidizer. Illustrative examples of an oxidizer include but are not limited to aluminum, ammonium perchlorate; ammonium nitrate; lithium nitrate, barium chlorate, barium nitrate, cesium nitrate, calcium nitrate, copper nitrate, hexanitroethane, potassium chlorate, potassium nitrate, sodium nitrate, rubidium nitrate, sulfur, chromium trichloride, molybdenum disulfide, iron trifluoride, or combinations thereof. Such oxidizers may be commercially obtained such as from Sigma-Aldrich, Co., St. Louis, Mo. Optionally, an oxidizer is present from 10 to 75 weight percent, or any value or range therebetween.

An explosive composition can be compounded, mixed, and formulated in any well-known manner for making explosive compositions. Some aspects of making an explosive composition include mixing or immersing one or more high energy materials into a melted nitramine binder until saturation of the solid material is achieved, or to such a less extent of solid material as desired. The resulting composition is optionally loaded into a detonable shape or instrument by transferring the melted material to a suitable container with a desired shape and allowing the composition to cool, either passively or actively.

For the nitramine binders that have a suitable melting point (e.g. 75-150° C.), the high energy material and binder are melted at the appropriate temperature to form a melted composition. The other desired ingredients are added to the molten phase and poured into a suitable warhead or mold.

The mixture is allowed to cool, solidify, and form a solid charge. Other suitable processing methods include thorough mixing of the powdered ingredients followed by pressing to form a consolidated charge.

Provided are dinitraminocarbocycles (nitramine) alone or used as insensitive melt-base binders for melt-cast energetic materials formulations. The dinitraminocarbocycle materials are energetic in their own right, which serves to increase the amount of energy available to the overall explosive composition formulation. Whereas conventional binder systems used to increase safety and handling properties are non-energetic, the dinitraminocarbocycle materials are both energetic and insensitive. These materials have thus far been found to be compatible with many types of energetic materials including N—$NO_2$, and C—$NO_2$ containing high energy compounds making it applicable as a melt cast binder for a variety of high energy materials.

Various aspects of the present invention are illustrated by the following non-limiting examples. The examples are for illustrative purposes and are not a limitation on any practice of the present invention. It will be understood that variations and modifications can be made without departing from the spirit and scope of the invention. A person of ordinary skill in the art readily understands where any and all necessary reagents may be commercially obtained or custom synthesized.

EXAMPLES

Example I

Production and Physical Characteristics of 1,3-dinitrohexahydropyrimidine (DHP)

1,3-dinitrohexahydropyrimidine (DHP) was prepared and its analysis was compared to published values as described in: Willer, R. L.; Atkins, R. L., *J. Org. Chem.,* 1984, 49, 5147-5150. Briefly, the precursor

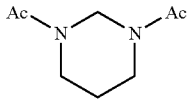

was prepared as follows: To a stirring 1 L beaker containing 500 mL of AcOH and 120 mL (129.85 g, 1.272 mol, 2.5 eq) of $Ac_2O$ was added 42.5 mL (37.75 g, 509.5 mmol) of 1,3-diaminopropane in one portion. The temperature of the beaker then spiked to approximately 80° C. and was allowed to cool to 50° C. and stirring was continued at that temperature for 2 hours. After the two hours had elapsed, 90 mL of a 37% solution of formaldehyde in water was added in one portion followed by 6 mL of 37% HCl. The solution was then allowed to stir for an additional 2 hours at 50° C. After the second 2 hour period was completed, the solution was concentrated using a rotary evaporator with a bath temperature of 80° C. The lowest yield on the process has been 69.38 (407.6 mmol, 80%) of a clear, slightly yellow oil and the material was used without further purification. Batches approaching 100 g have been produced and scaling this process has not caused any observed issues.

DHP on a 25 g scale was then formed using the precursor material as follows: To a 250 mL 3 neck flask was added 75 mL (81.15 g, 795.0 mmol 6 eq) of $Ac_2O$ and was cooled to below 10° C. using an ice bath. To the flask was then added 37.5 mL (56.7 g, 885 mmol, 6 eq) of 100% $HNO_3$ slowly keeping the temperature of the reaction below 10° C. After the addition was completed, the 6-member ring precursor from above (25 g, 146.8 mmol) was added at such a rate as to prevent the temperature of the solution from rising above 10° C. Upon completion of the addition, the solution was warmed to 40° C. for 4 hours at which point the whole solution was then poured over approximately 50 g of crushed ice. The resulting precipitant was filtered, then washed with approximately 500 mL of cold water. The material was then recrystallized from 200 mL of $H_2O$ and 50 mL of EtOH to yield 14.5 g (80.6 mmol, 55%).

NMR spectra were recorded on a Anasazi Instruments 90 MHz NMR with DMSO-$d_6$ as the solvent. All NMR chemical shifts are reported in ppm relative to TMS-CI. FTIR spectra were recorded using a Bruker Alpha-T fitted with a diamond ATR (DATR) cell. Density was measured using gas pycnometry on a Micromeritics AccuPyc 1330 using helium as the analysis gas.

Differential scanning calorimetry (DSC) was performed on a TA instruments 010 or 020 calorimeter calibrated to the melting point of indium. DSC measurements were performed in a pinhole pan as well as in a hermetically sealed pan. Based on the DSC trace of the material at 10°/min, in the pinhole, it was found to have a phase transition which occurs at approximately 80° C. followed by the complete melt at 86° C. The phase transition can be temporarily eliminated through rapid cycling of the material through its melt; however, it will reappear if the material is then allowed solidify and rest for a short period of time. This phase transition not observable in the hermetic pan where the phase transition and the melt appear together as a broad melt at approximately 80° C. In the pinhole pan, there is no observable exotherm as the material appears to boil off around 220° C. In the hermetic, an exotherm is observable at 267° C. with onset of decomposition beginning around 220° C.

$H_{50}$ values for drop weight testing were determined using the Langlie one-shot method on a tester dropping a 5 pound weight from a maximum height of 152 cm. Friction sensitivity measurements were determined on a BAM friction tester and ESD was determined using an ASL ESD apparatus.

All deuterated solvents were obtained from Cambridge Isotope Laboratories, Andover, Mass., U.S.A. All other materials used were obtained from Sigma Aldrich Corp. St. Louis, Mo., U.S.A. and were used as received unless otherwise noted.

The DHP material was found to have a drop height of >360 cm using a 2 kg weight, a BAM friction number of >360 N, and have an ESD value of 6.25 J. For comparison, the standard military explosive TNT has a drop height value of 119 cm, a friction measurement of 317 N, and an ESD of 0.625 J.

Example 2

Making and Testing of Explosive Compositions

DHP was mixed with ROX, HMX, or FOX-7 as follows. A 513.2 mg sample of DHP was melted using an oil bath heater set at 100° C. To this was added 732.9 mg of class V RDX slowly with stirring at which point the mixture became difficult to pour. The solid loading obtained was 59%.

A 492 mg sample of DHP was melted using an oil bath heater set at 100° C. To this was added 876 mg of class I HMX slowly with stirring at which point the mixture became difficult to pour. The solid loading obtained was 64%.

A 503 mg sample of DHP was melted using an oil bath heater set at 100° C. To this was added 501 mg of FOX-7 slowly with stirring at which point the mixture became difficult to pour. The solid loading obtained was 50%.

The resulting explosive compositions are tested by the same processes as was used for DHP alone. The results are presented in Table 2.

TABLE 2

| Materials | Solid Loading (wt %) | Impact (cm) | Friction (N) | ESD (J) |
|---|---|---|---|---|
| DHP and RDX Class I | 59 | 76.7 | >360 | 0.625 |
| DHP and HMX Class 5 | 64 | 84.6 | >360 | 0.625 |
| DHP and FOX-7 | 50 | >152 | >360 | >6.25 |
| RDX | N/A | 22.8 | 120 | 0.125 |
| HMX | N/A | 17.8 | 120 | 0.125 |
| DHP | N/A | >152 | >360 | >6.25 |
| TNT | N/A | 119 | 317 | 0.625 |

Various modifications of the present invention, in addition to those shown and described herein, will be apparent to those skilled in the art of the above description. Such modifications are also intended to fall within the scope of the appended claims.

It is appreciated that all reagents are obtainable by sources known in the art unless otherwise specified.

Patents and publications mentioned in the specification are indicative of the levels of those skilled in the art to which the invention pertains. These patents and publications are incorporated herein by reference to the same extent as if each individual application or publication was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

We claim:

1. A detonable composition comprising:

A detonable energetic material with a detonation velocity of 5.5 km/s or greater as measured by laser induced shock;

a melt-castable nitramine binder with a melting point of 150 degrees Celsius or below; and wherein said melt-castable nitramine binder comprises a structure of Formula I Formula I

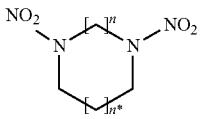

where n=1, 2, or 3 and n*=1, 2, or 3.

2. The composition of claim 1 wherein n and n* are each 1.

3. The composition of claim 1 wherein said melt-castable nitramine binder has a melting point of 80 degrees Celsius to 90 degrees Celsius.

4. The composition of claim 1 wherein said detonable energetic material is: 1,3,5,7-tetranitro-1,3,5,7-tetrazocane (1,3,5,7-tetranitro-1,3,5,7-tetrazocane; HMX); 2,2-bis(hydroxymethyl)1,3-propanediol (pentaerythritol tetranitrate; PETN); 2,4,6-trinitrotoluene (2-methyl-1,3,5-trinitrobenzene; TNT), 1,2,3-trinitroxypropane (trinitroglycerin; TNG); 2,3-dimethyl-2,3,-dinitrobutane (2,3-dimethyl-2,3-dinitrobutane; DMDNB); triacetone triperoxide (TATP); hexamethylene triperoxide diamine (HMTD); other peroxide or nitrate based explosive materials; gunpowder(s); pentaerythritol (2,2-Bis(hydroxymethyl)1,3-propanediol; PE); military or commercial grades of C4; Semtex A1; Semtex H; 2,4-dinitroanisole (DNAN), 1,3-Dinitrobenzene (1,3-DNB); 1,3,5-Trinitrobenzene (1,3,5-TNB); hexanitrostilbene (HNS); croconic acid; pentolite; 2,4,6-triamino-1,3,5-trinitrobenzene (TATB); comp B; nitrotriazalone (NTO); hexanitrohexaazaisowurtzitane (CL-20); 1,1-diamino-2,2-dinitroethene (DADNE; FOX-7); or combinations thereof.

5. An explosive composition comprising:

a detonable energetic material with a detonation velocity of 5.5 km/s or greater as measured by laser induced shock; and a melt-castable nitramine binder comprising a structure of Formula I Formula I

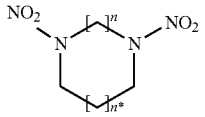

where n=1, 2, or 3 and n*=Q 1, 2, or 3.

6. The composition of claim 5 wherein n and n* are each 1.

7. The composition of claim 5 wherein said detonable energetic material is: 1,3,5,7-tetranitro-1,3,5,7-tetrazocane (1,3,5,7-tetranitro-1,3,5,7-tetrazocane; HMX); 2,2-bis(hydroxymethyl)1,3-propanediol (pentaerythritol tetranitrate; PETN); 2,4,6-trinitrotoluene (2-methyl-1,3,5-trinitrobenzene; TNT), 1,2,3-trinitroxypropane (trinitroglycerin; TNG); 2,3-dimethyl-2,3,-dinitrobutane (2,3-dimethyl-2,3-dinitrobutane; DMDNB); triacetone triperoxide (TATP); hexamethylene triperoxide diamine (HMTD); other peroxide or nitrate based explosive materials; gunpowder(s); pentaerythritol (2,2-Bis(hydroxymethyl)1,3-propanediol; PE); military or commercial grades of C4; Semtex A1; Semtex H; 2,4-dinitroanisole (DNAN), 1,3-Dinitrobenzene (1,3-DNB); 1,3,5-Trinitrobenzene (1,3,5-TNB); hexanitrostilbene (HNS); croconic acid; pentolite; 2,4,6-triamino-1,3,5-trinitrobenzene (TATB); comp B; nitrotriazalone (NTO); hexanitrohexaazaisowurtzitane (CL-20); 1,1-diamino-2,2-dinitroethene (DADNE; FOX-7); or combinations thereof.

* * * * *